United States Patent [19]

Bell

[11] Patent Number: 4,909,927

[45] Date of Patent: Mar. 20, 1990

[54] EXTRACTION OF HYDROCARBON OILS USING A COMBINATION POLAR EXTRACTION SOLVENT-ALIPHATIC-AROMATIC OR POLAR EXTRACTION SOLVENT-POLAR SUBSTITUTED NAPHTHENES EXTRACTION SOLVENT MIXTURE

[75] Inventor: James D. Bell, Toronto, Canada

[73] Assignee: Exxon Research and Engineering Company, Florham Park, N.J.

[21] Appl. No.: 934,698

[22] Filed: Dec. 4, 1986

Related U.S. Application Data

[63] Continuation-in-part of Ser. No. 815,204, Dec. 31, 1985, abandoned.

[51] Int. Cl.[4] ..... C10G 21/06

[52] U.S. Cl. ..... 208/326; 208/327; 208/323

[58] Field of Search ..... 208/326, 327, 323, 322

[56] References Cited

U.S. PATENT DOCUMENTS

| | | | |
|---|---|---|---|
| 2,228,507 | 1/1941 | Cook | 196/13 |
| 2,251,773 | 8/1941 | Agruss | 208/326 |
| 2,922,760 | 1/1960 | Beach et al. | 208/251 |
| 2,981,663 | 4/1961 | Black | 208/323 |
| 3,167,463 | 2/1965 | Norton et al. | 208/323 |
| 3,317,422 | 5/1967 | Benham | 208/327 |
| 3,366,568 | 1/1968 | Eisenlohr et al. | 208/323 |
| 3,415,743 | 12/1968 | Benham | 208/330 |
| 3,449,462 | 6/1969 | Alders et al. | 260/674 |
| 3,458,431 | 7/1969 | Nixon | 208/22 |
| 3,673,081 | 6/1972 | Preusser et al. | 208/326 X |
| 3,721,620 | 3/1973 | Paret et al. | 208/326 X |
| 3,779,904 | 12/1973 | Kubek et al. | 208/333 |
| 3,816,302 | 6/1974 | Paret | 208/326 X |
| 4,013,549 | 3/1977 | Bushnell | 208/323 |
| 4,125,458 | 11/1978 | Bushnell et al. | 208/309 |
| 4,325,818 | 4/1982 | Woodle | 208/326 |
| 4,333,824 | 6/1982 | Brown et al. | 208/326 |

FOREIGN PATENT DOCUMENTS

| | | |
|---|---|---|
| 859344 | 8/1981 | U.S.S.R. . |
| 1150308 | 10/1966 | United Kingdom . |
| 1283147 | 7/1972 | United Kingdom . |
| 1341296 | 12/1973 | United Kingdom . |

*Primary Examiner*—Glenn Caldarola

*Attorney, Agent, or Firm*—Joseph J. Allocca

[57] ABSTRACT

Hydrocarbon oils, particularly petroleum oils, more particularly lube, transformer, white oil and other specialty oils can be extracted to remove aromatic hydrocarbon components therefrom using a combination polar extraction solvent, such as n-methyl pyrrolidone phenol or furfural, preferably NMP in combination with aliphatic-aromatics, polar naphthenes or morpholine, preferably alkylbenzene, mixed extraction solvent.

The combination of polar extraction solvent and aliphatic-aromatic, polar naphthene or morpholine extraction solvent mixture contains and from 1 to up to but not including 10 LV % aliphatic-aromatic, polar naphthene or morpholine and mixtures thereof, preferably from 2.5 to less than 10% aliphatic-aromatic, polar naphthene or morpholine and from 0 to 10 LV % water, the amount of polar extraction solvent being suitably adjusted to reflect the presence of the water. Extraction using the combination solvent is conducted at a temperature above the haze point of the oil being extracted but at tower bottoms temperature at least 30° C., and preferably 40° C., or more below the critical solution temperature of the feed-solvent mixture.

9 Claims, 3 Drawing Sheets

EXTRACTION OF HYDROCARBON OILS USING A COMBINATION POLAR EXTRACTION SOLVENT-ALIPHATIC-AROMATIC OR POLAR EXTRACTION SOLVENT-POLAR SUBSTITUTED NAPHTHENES EXTRACTION SOLVENT MIXTURE

CROSS-REFERENCE TO RELATED APPLICATION

This application is a continuation-in-part application of U.S. Ser. No. 815,204, filed Dec. 31, 1985, abandoned.

BRIEF DESCRIPTION OF THE INVENTION

This invention relates to a process for extracting hydrocarbon oils using polar extraction solvents, such an n-methyl-2-pyrrolidone (NMP), phenol or furfural, in combination with an additional component, selected from aliphatic aromatics, polar naphthenes or morpholine and mixtures thereof as the extraction solvent mixture. Use of this combination extraction solvent produces about the same yield of oil at the same level of quality, but at a significantly lower solvent treat ratio as compared to just polar extraction solvents, such as NMP, phenol or furfural. Extraction using the combination extraction solvent is conducted at a temperature above the haze point of the oil being extracted and above that required to maintain feed viscosity below about 200 cSt, but at least 30° C., preferably 40° C. or more, below the critical solution temperature of the feed and solvent mixture. Operation in this range avoids or minimizes detrimental effects on yields.

BACKGROUND OF THE INVENTION

Solvent extraction of hydrocarbon oils using polar solvents to remove aromatic constituents has long been a standard processing procedure in the oil industry. The use of NMP to selectively extract aromatic components from an oil stream is the subject of many patents, see, for instance, U.S. Pat No. 3,843,525, U.S. Pat. No. 3,476,681, U.S. Pat. No. 4,125,458.

In U.S. Pat. No. 4,333,824 a solvent refining process is described which employs N-methyl-2-pyrrolidone plus recycled extract. In U.S. Pat. No. 4,325,818 an NMP extraction process is improved by contacting the extract in the extraction with a paraffinic backwash oil (BP 190°–210° C.) in order to further displace the non-aromatics into the raffinate.

U.S. Pat. No. 3,415,743 describes an extraction procedure for aromatic hydrocarbons. Heavy aromatics and heavy aliphatics are extracted from cracking cycle oil by extracting the cycle oil with DMF/water solvent solution plus a displacer oil. The displacer oil is preferably a heavy naphtha containing 10–50% lower alkyl benzenes, especially xylene.

U.S. Pat. No. 3,317,422 practices aromatics extraction using furfural, furfural alcohol and water. The process also employs light catalytic cycle oil and displacer oil as feed for respective extraction zones. The displacer oil is a mixture of non-aromatic compounds, such as heavy naphtha, and 10 to 50% xylenes.

DESCRIPTION OF THE INVENTION

Figure 1:
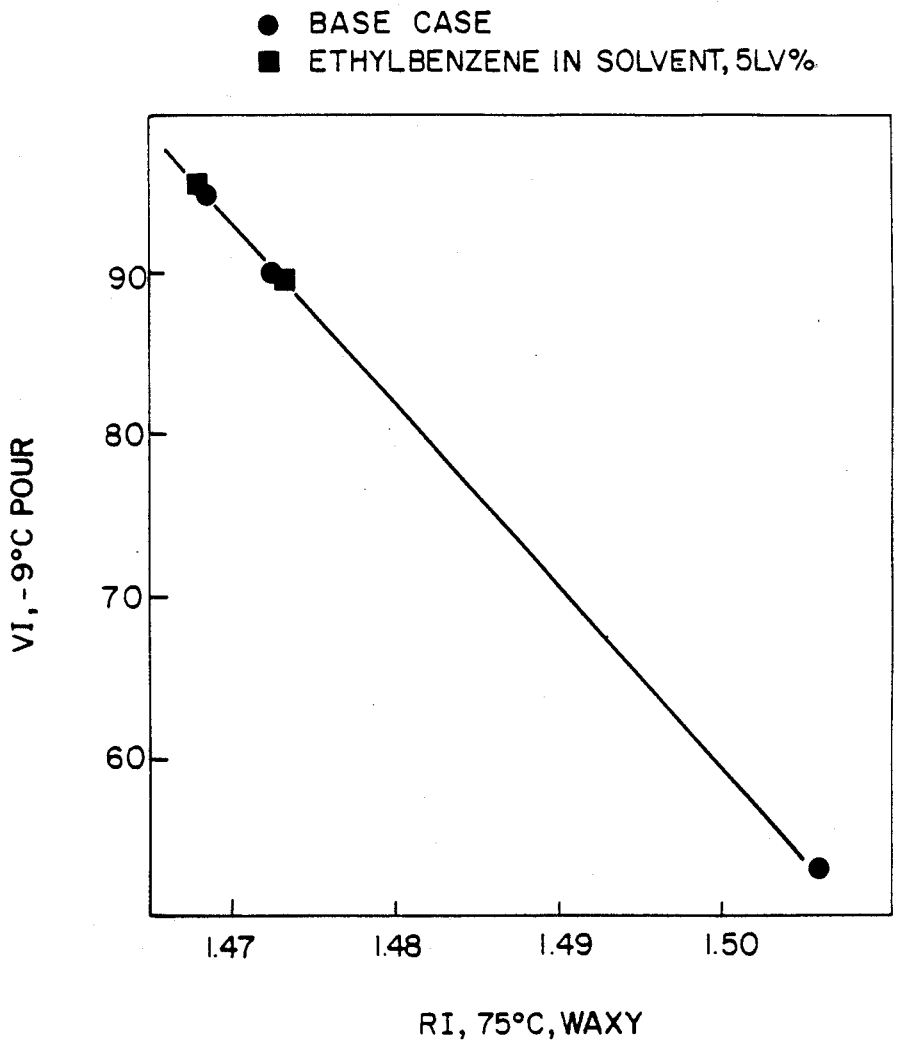
FIG. 1 represents the relationship between viscosity index and refractive index for products produced using extraction solvents, both with and without ethylbenzene additive.

Hydrocarbon oils, particularly petroleum oils, especially lube oils, transformer oils, turbine oils, refrigerator oils, white oils and other specialty oils are extracted to remove aromatic hydrocarbons therefrom using a combination polar extraction solvent such as n-methyl-2-pyrrolidone (NMP), phenol or furfural, preferably NMP, in combination with aliphatic aromatics, polar naphthenes or morpholine and mixtures thereof as the extraction solvent mixture. For the sake of simplicity, the first component will be referred to as NMP in this specification, but it is to be understood that other standard, commonly used extraction solvents can also be employed and are also embraced within this specification.

The combination NMP and aliphatic-aromatic, polar naphthene or morpholine extraction solvent mixture contains from about 1 to up to but not including 10 LV % added component, preferably about 2.5 to up to but not including 10 LV % added component, more preferably between about 2.5 to 5 LV % aliphatic-aromatic, polar naphthene or morpholine. Most preferably, about 5 LV % aliphatic-aromatic, polar naphthene or morpholine is used. In addition, water can be present at a concentration of from 0 to 10 LV % (the amount of NMP present being suitably adjusted to reflect the presence of water.

Extraction using the combination extraction solvent is conducted at a temperature above the haze point of the oil being extracted and a temperature above that required to maintain feed viscosity below 200 cSt but at least 30° C., preferably 40° C. or more, below the critical solution temperature of the feed and solvent in order to avoid or minimize detrimentally affecting yields.

The aliphatic-aromatic component of the combination extraction solvent is selected from monoalkylaromatics and polyalkylaromatics, preferably mono- and polyalkyl benzene. Aromatics are understood to include benzene and compounds that resemble benzene in chemical behavior, such as pyrrole, furan and thiophene. Representative examples of aliphatic-aromatics include ethylbenzene, propylbenzene, isopropylbenzene, butylbenzene, isobutylbenzene, tertbutylbenzene, methylpyrrole. The aromatic moiety should not be substituted with any polar groups as polar substituted aromatics do not exhibit good additive performance. The aliphatic aromatic molecules preferred in the present invention are those having molecular weights of at least 78, preferably in the range 96 to 134. The polar naphthenes include, for example, cyclohexanone, cyclohexylamine, cyclohexanol. All of these additives are selected so as to have boiling points between 40° to 250° C., preferably to have boiling points above that of water but below that of the polar extraction solvent with which they are combined, however, additives having the higher molecular weight and boiling points within these preferred limitations are preferred as yield benefits become more pronounced.

The polar extraction solvent and added aliphatic-aromatics, polar naphthenes or morpholine are employed simultaneously on the hydrocarbon oil to be extracted in the same extraction zone, preferably as a premixed mixture. By this, it is to be understood that each component is present in the extraction zone and both are functioning simultaneously as the extraction process solvent. Both components are introduced at the same or substantially the same point of introduction so that the hydrocarbon oil passing countercurrent to the extraction solvent is exposed to the combination in its countercurrent passage. The full benefit of the present invention is not achieved if the aliphatic-aromatic polar naphthene or morpholine component is simply employed as a diluent in the oil, or if the components are employed sequentially in separate zones.

Use of this combination extraction solvent mixture produces at least the same yield of oil (provided the extraction temperature is at least 30° C., preferably 40° C. or more below the critical solution temperature of the feed/solvent mixture) at the same level of quality as using just polar extraction solvent such as NMP, phenol or furfural, but at a significantly lower treat rate. In the preferred embodiments both treat level and yield exhibit a credit.

EXPERIMENTAL

Countercurrent extractions with NMP solvent "spiked" with ethylbenzene were carried out on three distillate stocks, BSM/AL (70/30%) 600N, Arab Lt. 150N and Arab Lt. 600N. In each case NMP containing 5.0 LV % ethylbenzene reduced the treat requirement by 10–15% (relative). No changes in yield were observed with extractions of Arab Light 150N and 600N distillates performed with a bottoms temperature below 80° C. This bottoms temperature is more than 40° C. below the critical solution temperature of the feed/solvent mixture. Extraction yield debits of about 4 LV % were noted with two distillates, BSM/AL 600N and Arab Light 600N when operating at extraction bottoms temperatures of 102° and 93° C. respectively. These latter extractions were performed with tower bottoms temperatures within 25° C. of the critical solution temperature of the feed/solvent mixture.

In the case of the Arab Lt. 150N distillate the amount of ethylbenzene in solvent was also varied (2.5, 5.0 and 10.0 LV %) in order to determine the effect on yield and treat and to optimize the ethylbenzene concentration. Results indicated that the optimum level is in the range of 5.0 LV %.

The addition of ethylbenzene to NMP solvent had no measured effect on waxy or dewaxed oil inspections.

Distillate inspections are tabulated in Table 1. A small scale countercurrent extractor was used for all runs.

EXAMPLE I—BSM/AL (70/30%) 600N Distillate

Extractions using NMP were performed on the BSM/AL (70/30) 600N distillate using an additive-free solvent and solvent "spiked" with 5.0 LV % ethylbenzene. The data are tabulated in Table 2. The results show that at constant extraction temperature (Top/Bottom, 110°/102° C.) and water in solvent (2.0 LV %) the addition of 5.0 LV % ethylbenzene reduced the treat requirement by 15 relative percent (at 95 VI, −9° C. pour point), but raffinate yield was lower by 4 LV %. As previously stated, extraction performed with a tower bottoms temperature of 25° C. or less below the critical solution temperature of the feed-solvent mixture results in a yield debit.

EXAMPLE II

The poor yield performance on the BSM/AL 600N distillate indicated that the advantages of ethylbenzene were dependent on the distillate or some other extraction parameters. To address these dependencies, additional extractions were performed on an Arab Light 600N distillate with NMP solvent containing 5.0 LV % ethylbenzene. Extraction results are shown in Table 3. At constant temperature (Top/Bottom 81°/73° C.) and water (2.4 LV %), the addition of the ethylbenzene lowered the solvent treat by 15 relative percent for a given raffinate quality (93 VI, −9° C. pp). There was no effect on raffinate yield. In this Example the extraction was conducted with a tower bottoms temperature of more than 40° C. below the critical solution temperature of the feed-solvent mixture, thus, no yield debit was experienced.

EXAMPLE III

To further evaluate the effect of extraction conditions on the benefits of ethylbenzene in NMP solvent additional extractions with both clean and "spiked" solvent, were carried out on the Arab Lt. 600N at the higher temperature (Top/Bottom 101°/93° C.). Water (2.4 LV %) and ethylbenzene (5.0 LV %) in solvent remained unchanged. Extraction data are given in Table 4. Run 3 was disregarded because of high entrainment (27 LV %); this may have been due to the combination of the ethylbenzene additive, high extraction temperature and low solvent treat (108 LV %). At a higher solvent treat, the addition of ethylbenzene reduced the treat requirement by 10 relative percent for a given raffinate quality. However, the yield was 3.4 LV % lower. These data are consistent with the BSM/AL 600N data that showed a treat credit of about 15 relative percent with a yield debit of about 4 LV % with 5.0 LV % ethylbenzene at extraction conditions of water in solvent 2.0 LV %, temperature, top/bottom 110°/102° C. In this Example (top bottoms 101°/93° C.) the extraction was conducted with a tower bottoms temperature of less than 25° C. below the critical solution temperature of the feed-solvent mixture.

TABLE 1

| | DISTILLATE INSPECTIONS | | | | |
|---|---|---|---|---|---|
| Distillate: | BSM/AL (70/30) 600N | ARAB LT. 150N FRESH INSPECTION* | ARAB LT. 150N SECOND INSPECTION* | ARAB LT. 600N FIRST INSPECTION* | ARAB LT. 600N SECOND INSPECTION* |
| Waxy Inspections | | | | | |
| Refractive Index @ 75° C. | 1.4939 | 1.4918 | 1.4912 | 1.5057 | 1.5058 |
| Gravity, ÅPI | 21.7 | 22.7 | — | 19.1 | — |
| Density at 15° C., kg/dm$^3$ | 0.9231 | 0.9171 | 0.9183 | 0.9390 | 0.9422 |

TABLE 1-continued

| Distillate: | BSM/AL (70/30) 600N | DISTILLATE INSPECTIONS ARAB LT. 150N FRESH INSPECTION* | ARAB LT. 150N SECOND INSPECTION* | ARAB LT. 600N FIRST INSPECTION* | ARAB LT. 600N SECOND INSPECTION* |
|---|---|---|---|---|---|
| Viscosity, 40° C., cSt | — | 38.75 | — | — | — |
| Viscosity, 100° C., cSt | 14.52 | 5.70 | 5.70 | 16.56 | 16.41 |
| GC Distillation, °C. | | | | | |
| % Off ibp | 403 | 328 | | 378 | |
| 1 | 415 | 338 | | 394 | |
| 3 | 436 | 355 | | 421 | |
| 5 | 447 | 365 | | 434 | |
| 10 | 461 | 379 | | 455 | |
| 20 | 476 | 396 | | 476 | |
| 30 | 485 | 410 | | 488 | |
| 40 | 493 | 421 | | 496 | |
| 50 | 501 | 432 | | 504 | |
| 60 | 509 | 441 | | 512 | |
| 70 | 518 | 451 | | 522 | |
| 80 | 530 | 461 | | 533 | |
| 90 | 546 | 473 | | 550 | |
| 95 | 559 | 481 | | 564 | |
| fbp | 592 | 499 | | 596 | |
| Dewaxed Oil Inspections | (1) | (2) | (2) | (3) | |
| Wax Content, Wt. % | 11.6 | 9.4 | 9.4 | 8.3 | 8.3 |
| Refractive Index at 75° C. | 1.5016 | 1.4984 | 1.4984 | 1.5115 | 1.5115 |
| Gravity, ÅPI | 21.1 | 21.1 | — | 17.5 | — |
| Density at 15° C., kg/dm$^3$ | 0.9267 | 0.9267 | 0.9267 | 0.9491 | 0.9491 |
| Viscosity 40° C., cSt | 281.22 | 48.02 | 48.02 | 325.89 | 325.89 |
| 100° C., cSt | 17.46 | 6.20 | 6.20 | 18.89 | 18.89 |
| Viscosity Index | 53.1 | 63.2 | 63.1 | 50.9 | 51.1 |
| Pour °C. | −15 | −12 | −12 | −15 | −15 |
| Sulfur, Wt. % | 1.47 | 2.75 | 2.75 | 3.02 | 3.02 |
| Basic Nitrogen, wppm | 406 | 193 | 193 | 320 | 320 |
| HPLC Separation | | | | | |
| Saturates, Wt. % | 43.3 | 42.9 | 42.9 | 33.5 | |
| Aromatics/Polars, Wt. % | 52.3 | 54.0 | 54.0 | 59.8 | |
| Recovery, Wt. % | 95.6 | 96.9 | — | 93.3 | |

(1) Dewaxed using 40/60 LV % MEK/MIBK, 3/1 w/w s/o, filtered at −12° C.
(2) Dewaxed using 100 LV % MIBK, 2.5/1 w/w s/o, filtered at −15° C.
(3) Dewaxed using 100 LV % MIBK, 3/1 w/w s/o, filtered at −13° C.
*First and second inspections are assays conducted on samples of Arab Light 150N and Arab Light 600N taken from same drums of Arab Light 150N and Arab Light 600N respectively, but at different times. Difference in inspections for each oil is solely a reflection of these different assays conducted at different times.

TABLE 2

NMP EXTRACTION OF BSM/AL (70/30) 600N DISTILLATE USING SOLVENT WITH AND WITHOUT ETHYLBENZENE
(countercurrent data)

| | | | | |
|---|---|---|---|---|
| Extraction Conditions | | | | |
| Temperature °C., T/B | 110/102 | 110/102 | 110/102 | 110/102 |
| Water in Solvent, LV % | 2.0 | 2.0 | 2.0 | 2.0 |
| Ethylbenzene in Solvent, LV % | — | — | 5.0 | 5.0 |
| Treat, LV % | 255 | 144 | 211 | 126 |
| Yield, LV % | 42.2 | 51.1 | 38.2 | 47.2 |
| Extract Inspections | | | | |
| Oil Content, wt % | 17.9 | 25.8 | 22.2 | 30.7 |
| Refractive Index at 75° C. | 1.5201 | 1.5263 | 1.5164 | 1.5218 |
| Gravity ÅPI | 15.8 | 14.6 | 16.6 | 15.6 |
| Density at 15° C., kg/dm$^3$ | 0.9601 | 0.9680 | 0.9549 | 0.9614 |
| Viscosity, 100°DC, cSt | 22.0 | 23.91 | 20.51 | 22.09 |
| Entrainment, LV % | 0 | 0 | 0 | 0 |
| Raffinate Inspections | | | | |
| Solvent Content, wt % | 18.7 | 20.8 | 23.7 | 26.8 |
| Refractive Index at 75° C. | 2.4583 | 1.4630 | 1.4582 | 1.4632 |
| Gravity ÅPI | 30.7 | 29.2 | 30.9 | 29.3 |
| Density at 15° C., kg/dm$^3$ | 0.8719 | 0.8801 | 0.8708 | 0.8795 |
| Viscosity, 100° C., cSt | 10.13 | 10.63 | 10.04 | 10.63 |
| Dewaxed Oil Inspections[1] | | | | |
| Wax Content, Wt. % | 26.7 | 22.0 | 26.3 | 21.5 |
| Refractive Index at 75° C. | 1.4632 | 1.4678 | 1.4624 | 1.4678 |
| Gravity, ÅPI | 29.6 | 28.0 | 29.7 | 28.1 |
| Density at 15° C., kg/dm$^3$ | 0.8779 | 0.8867 | 0.8773 | 0.8861 |
| Viscosity, 40° C., cSt | 103.97 | 118.94 | 102.19 | 118.88 |
| 100° C., cSt | 11.66 | 12.35 | 11.60 | 12.35 |
| Viscosity Index | 99.6 | 93.7 | 100.8 | 93.8 |
| Pour, °C. | −12 | −12 | −9 | −12 |
| Sulphur, wt % | 0.31 | 0.57 | 0.30 | 0.58 |

TABLE 2-continued

NMP EXTRACTION OF BSM/AL (70/30) 600N DISTILLATE USING SOLVENT WITH AND WITHOUT ETHYLBENZENE (countercurrent data)

| | | | | |
|---|---|---|---|---|
| Basic Nitrogen, wppm | 62 | 107 | 60 | 110 |
| HPLC Separation | | | | |
| Saturates, wt % | 75.9 | 68.5 | 77.1 | 67.7 |
| Aromatics/Polars, wt % | 21.4 | 28.4 | 20.7 | 29.1 |
| Recovery, wt % | 97.3 | 97.0 | 97.8 | 96.7 |
| Mass Spec for Aromatics, LVP | | | | |
| Alkylbenzenes | 7.01 | 8.72 | 7.99 | 9.61 |
| Naphtheno Aromatics | 8.76 | 10.12 | 8.17 | 10.76 |
| Two Ring Aromatics | 3.38 | 5.73 | 3.45 | 5.67 |
| Three + Ring Aromatics | 1.63 | 2.66 | 0.56 | 1.75 |
| Sulphur Aromatics | 0.39 | 0.66 | 0.34 | 0.88 |
| Unidentifiable Aromatics | 0.21 | 0.52 | 0.19 | 0.44 |

[1]Dewaxed using 40/60 LV % MEK/MIGBK, 3/1 w/w s/o, filtered at −12° C.

TABLE 3

LOW TEMPERATURE NMP EXTRACTION OF ARAB LT. 600N DISTILLATE (FRESH INSPECTION) USING SOLVENT WITH AND WITHOUT ETHYLBENZENE ADDITIVE (Countercurrent Data)

| | | | | |
|---|---|---|---|---|
| Extraction Conditions | | | | |
| Temperature °C., T/B | 81/73 | 81/73 | 81/73 | 81/73 |
| Water in Solvent, LV % | 2.4 | 2.4 | 2.4 | 2.4 |
| Ethylbenzene in Solvent, LV % | — | — | 5.0 | 5.0 |
| Treat, LV % | 141 | 229 | 136 | 212 |
| Yield, LV % | 64.6 | 59.1 | 63.7 | 57.8 |
| Extract Inspections | | | | |
| Oil Content, wt % | 21.1 | 15.4 | 22.7 | 17.1 |
| Refractive Index at 75° C. | 1.5643 | 1.5569 | 1.5624 | 1.5548 |
| Gravity, ÅPI | 7.1 | 8.4 | 7.4 | 8.8 |
| Density at 15° C., kg/dm$^3$ | 1.0203 | 1.0108 | 1.0181 | 1.0080 |
| Viscosity, 100° C., cSt | 40.25 | 36.02 | 39.08 | 34.73 |
| Entrainment, LV % | 0 | 0 | 0 | 0 |
| Raffinate Inspections | | | | |
| Solvent Content, wt % | 15.3 | 13.9 | 20.3 | 18.7 |
| Refractive Index at 75° C. | 1.4728 | 1.4692 | 1.4724 | 1.4683 |
| Gravity, ÅAPI | 26.4 | 27.3 | 26.5 | 27.3 |
| Density at 15° C., kg/dm$^3$ | 0.8956 | 0.8906 | 0.8951 | 0.8906 |
| Viscosity, 100° C., cSt | 12.20 | 11.74 | 12.18 | 11.69 |
| Dewaxed Oil Inspections[1] | | | | |
| Wax Content, wt % | 13.3 | 14.2 | 13.1 | 14.5 |
| Refractive Index at 75° C. | 1.4773 | 1.4733 | 1.4772 | 1.4727 |
| Gravity ÅPI | 25.5 | 26.5 | 25.6 | 26.7 |
| Density at 15° C., kg/dm$^3$ | 0.9008 | 0.8951 | 0.9002 | 0.8940 |
| Viscosity, 40° C., cSt | 144.81 | 131.11 | 143.80 | 129.81 |
| 100° C., cSt | 13.75 | 13.20 | 13.72 | 13.14 |
| Viscosity Index | 89.5 | 93.9 | 90 | 94.4 |
| Pour, °C. | −9 | −9 | −9 | −9 |
| Sulphur, wt % | 1.46 | 1.18 | 1.43 | 1.14 |
| Basic Nitrogen, wppm | 92 | 81 | 98 | 69 |
| HPLC Separation | | | | |
| Saturates, wt % | 50.4 | 55.4 | 51.1 | 55.7 |
| Aromatics + Polars, wt % | 44.7 | 40.9 | 44.7 | 39.7 |
| Recovery, wt % | 95.1 | 96.3 | 95.8 | 95.4 |

[1]Dewaxed using 100 LV % MIBK, 3/1 w/w s/o, filtered at −13° C.

TABLE 4

HIGH TEMPERATURE NMP EXTRACTION OF ARAB LT. 600N DISTILLATE USING SOLVENT WITH AND WITHOUT ETHYLBENZENE (countercurrent data)

| Run | 1 | 2 | 3 | 4 |
|---|---|---|---|---|
| Extraction Conditions | | | | |
| Temperature °C., T/B | 101/93 | 101/93 | 101/93 | 101/93 |
| Water in Solvent, LV % | 2.4 | 2.4 | 2.4 | 2.4 |
| Ethylbenzene in Solvent, LV % | — | — | 5.0 | 5.0 |
| Treat, LV % | 109 | 173 | 108 | 161 |
| Yield, LV % | 52.2 | 47.8 | 49.9 | 44.4 |
| Extract Inspections | | | | |
| Oil Content, wt % | 32.0 | 23.4 | 34.1 | 26.3 |

TABLE 4-continued

HIGH TEMPERATURE NMP EXTRACTION OF ARAB LT. 600N DISTILLATE USING SOLVENT WITH AND WITHOUT ETHYLBENZENE (countercurrent data)

| Run | 1 | 2 | 3 | 4 |
|---|---|---|---|---|
| Refractive Index at 75° C. | 1.5433 | 1.5408 | 1.5402 | 1.5372 |
| Gravity, ÅPI | 11.1 | 11.5 | 11.9 | 12.4 |
| Density at 15° C., kg/dm$^3$ | 0.9917 | 0.9889 | 0.9862 | 0.9827 |
| Viscosity, 100° C.f, cSt | 27.69 | 27.42 | 26.41 | 25.62 |
| Entrainment, LV % | 1.0 | 0 | 3.5 (27) | 0.5 |
| Raffinate Inspections | | | | |
| Solvent Content, wt % | 20.3 | 18.5 | 25.7 | 23.3 |
| Refractive Index at 75° C. | 1.47063 | 1.4663 | 1.4703 | 1.4658 |
| Gravity, ÅPI | 27.1 | 28.1 | 26.9 | 28.3 |
| Density at 15° C., kg/dm$^3$ | 0.8917 | 0.8861 | 0.8928 | 0.8850 |
| Viscosity, 100° C., cSt | 11.86 | 11.42 | 11.88 | 11.36 |
| Dewaxed Oil Inspections[1] | | | | |
| Wax Content, wt % | 13.62 | 15.33 | — | 15.1 |
| Refractive Index at 75° C. | 1.4748 | 1.4703 | — | 1.4698 |
| Gravity ÅPI | 26.2 | 27.4 | — | 27.4 |
| Density at 15° C., kg/dm$^3$ | 0.8968 | 0.8900 | — | 0.8900 |
| Viscosity, 40° C., cSt | 135.35 | 121.36 | — | 120.20 |
| 100° C., cSt | 13.36 | 12.80 | — | 12.72 |
| Viscosity Index | 92.4 | 97.5 | — | 97.6 |
| Pour, °C. | −9 | −9 | — | −9 |
| Sulphur, wt % | 1.29 | 0.98 | — | 0.96 |
| Basic Nitrogen, wppm | 85 | 65 | — | 63 |
| HPLC Separation | | | | |
| Saturates, wt % | 53.7 | 59.5 | — | 58.8 |
| Aromatics + Polars, wt % | 42.7 | 39.9 | — | 37.9 |
| Recovery, wt % | 96.4 | 99.4 | — | 96.7 |

[1]Dewaxed using 100 LV % MIBK, 3/1 w/w s/o, filtered at −13° C.

EXAMPLE IV - Arab Lt. 150N Distillate

NMP extractions were carried out on the Arab Lt. 150N distillate with and without ethylbenzene in the NMP solvent. Concentrations were varied (0, 2.5, 5.0 and 10.0 LV %) in order to determine the effect of ethylbenzene concentration on yield and treat and to optimize the ethylbenzene concentration on yield and treat.

Prior to extraction a miscibility study was carried out using 0, 5.0, 10.0 and 50.0 LV % ethylbenzene in NMP to define potential miscibility or carry-under problems. The data given on Table 5 indicated that at an extractor bottoms temperature of 62° C. little carryunder should arise at ethylbenzene concentrations less than 10 LV %.

TABLE 5

PORT JEROME ARAB LT. 150N DISTILLATE MISCIBILITY STUDY USING NMP SOLVENT "SPIKED" WITH ETHYLBENZENE

| | LV % Ethylbenzene | | | |
|---|---|---|---|---|
| | 0 | 5 | 10 | 50 |
| S/O Ratio | Miscibility Temperature, °C. | | | |
| 0.5/1 | 100 | 97 | 94.6 | 83 |
| 1/1 | 106 | 102.4 | 100.4 | 79.6 |
| 1.5/1 | 110 | 105.5 | 102.8 | 77 |
| 2.0/1 | 110.5 | 105.2 | 102 | 62 |
| 2.5/1 | 109.5 | 105 | 101 | — |
| 3.0/1 | 108.5 | 104.2 | 99.5 | — |

The extraction data are given in Table 6. At constant extraction temperature (Table 6) (Top/Bottom 70°/62° C.) and water in solvent (2.4 LV %) both 2.5 and 5.0 LV % ethylbenzene in NMP lowered the solvent treat by 10–15 relative percent (at 100 to 105 VI, −9° C. pour). Raffinate yield was not affected. Again, the extraction was performed at a tower bottoms temperature of more than 40° C. below the critical solution temperature of the feed-solvent mixture.

With the addition of 10 LV % ethylbenzene, treat was not affected at the 100 VI level but was 15 relative percent lower at the 105 VI level. However, there was a yield debit of 2.6 LV %. This data indicated that the optimum level of ethylbenzene in NMP is in the range of 2.5–5.0 LV %, even when the extractions are performed at a tower bottoms temperature of more than 40° C. below the critical solution temperature of the feed-solvent mixture.

In Table 6A extraction conditions were varied in runs 1 and 2, in which no additive was employed. At higher bottoms temperatures there was a noticeable yield debit (at constant quality). Ethylbenzene (runs 3 and 4) was also employed at higher bottoms temperatures as compared to no additive base cases (runs 1 and 2) and proved to exhibit good relative treat credits but which were offset by significant yield debits. As previously stated and as shown in Table 7, this yield debit phenomenon occurs when the extractions are performed at tower bottoms temperatures of less than 40° C. below the critical solution temperature of the feed/solvent mixture.

Table 7 summarizes this yield debit.

TABLE 6

NM EXTRACTION OF ARAB LT. 150N (1st INSPECTION) USING SOLVENT WITH AND WITHOUT ETHYLBENZENE ADDITIVE
(countercurrent data)

| | | | | | | | | | |
|---|---|---|---|---|---|---|---|---|---|
| Extraction Conditions | | | | | | | | | |
| Temperature °C., T/B | 70/62 | 70/62 | 70/62 | 70/62 | 70/62 | 70/62 | 70/62 | 70/62 | 70/62 |
| Water in Solvent, LV % | 2.4 | 2.4 | 2.4 | 2.4 | 2.4 | 2.4 | 2.4 | 2.4 | 2.4 |
| Ethylbenzene in Solvent, LV % | — | — | — | 5.0 | 5.0 | 10.0 | 10.0 | 2.5 | 2.5 |
| Treat, LV % | 164 | 115 | 79 | 142 | 92 | 143 | 92 | 142 | 91 |
| Yield, LV % | 61.1 | 64.3 | 69.3 | 60.4 | 66.7 | 58.5 | 68.8 | 60.3 | 66.8 |
| Extract Inspections | | | | | | | | | |
| Oil Content, wt % | 19.3 | 24.4 | 30.2 | 22.6 | 29.0 | 23.7 | 29.9 | 22.0 | 28.8 |
| Refractive Index at 75° C. | 1.5462 | 1.5499 | 1.5558 | 1.5443 | 1.5523 | 1.5406 | 1.5547 | 1.5452 | 1.5527 |
| Gravity ÅPI | 10.4 | 10.0 | 9.0 | 11.0 | 9.6 | 11.5 | 9.0 | 11.0 | 9.5 |
| Density at 15° C., kg/dm$^3$ | 0.9966 | 0.9994 | 1.0065 | 0.9924 | 1.0022 | 0.9889 | 1.0065 | 0.9924 | 1.0029 |
| Viscosity, 100° C., cSt | 8.26 | 8.29 | 8.53 | 8.17 | 8.37 | — | — | — | — |
| Entrainment, LV % | 0 | 0 | 0 | 0 | 0 | 0 | 0 | 0 | |
| Raffinate Inspections | | | | | | | | | |
| Solvent Content, wt % | 11.9 | 12.9 | 14.6 | 17.9 | 18.6 | 22.8 | 25.4 | 14.7 | 16.4 |
| Refractive Index at 75° C. | 1.4565 | 1.4592 | 1.4635 | 1.4568 | 1.4611 | 1.4565 | 1.4627 | 1.4566 | 1.4614 |
| Gravity, ÅPI | 31.5 | 30.7 | 29.7 | 31.3 | 30.1 | 31.6 | 29.7 | 31.5 | 30.2 |
| Density at 15° C., kg/dm$^3$ | 0.8676 | 0.8719 | 0.8773 | 0.8687 | 0.8752 | 0.8671 | 0.8773 | 0.8676 | 0.8746 |
| Viscosity, 40° C., cSt | 26.28 | 27.06 | 28.64 | 26.29 | 27.78 | — | — | — | — |
| 100° C., cSt | 5.03 | 5.07 | 5.18 | 5.02 | 5.11 | — | — | — | — |
| Dewaxed Oil Inspections (1) | | | | | | | | | |
| Wax Content, wt % | 15.3 | 14.5 | 13.4 | 15.2 | 13.8 | — | — | — | — |
| Refractive Index at 75° C. | 1.4613 | 1.4642 | 1.4684 | 1.4617 | 1.4662 | — | — | — | — |
| Gravity, ÅPI | 30.4 | 29.6 | 28.3 | 30.3 | 29.0 | — | — | — | — |
| Density at 15° C., kg/dm$^3$ | 0.8735 | 0.8779 | 0.8850 | 0.8741 | 0.8811 | — | — | — | — |
| Viscosity, 40° C., cSt | 31.78 | 32.92 | 34.90 | 31.86 | 33.67 | — | — | — | — |
| 100° C., cSt | 5.425 | 5.49 | 5.61 | 5.44 | 5.53 | — | — | — | — |
| Viscosity Index | 105 | 101.9 | 97.1 | 105.4 | 99.8 | — | — | — | — |
| Pour °C., ASTM | −9 | −9 | −9 | −9 | −9 | — | — | — | — |
| Sulphur, wt % | 0.83 | 1.01 | 1.23 | 0.85 | 1.16 | — | — | — | — |
| Basic Nitrogen, wppm | 32 | 41 | 62 | 31 | 52 | — | — | — | — |
| HPLC Separation | | | | | | | | | |
| Saturates, wt % | 68.4 | 65.7 | 60.3 | 70.2 | 62.4 | — | — | — | — |
| Aromatics + Polars, wt % | 30.4 | 34.3 | 38.2 | 31.5 | 35.6 | — | — | — | — |
| Recovery, wt % | 98.8 | 100 | 98.5 | 101.7 | 98.0 | — | — | — | — |
| Mass Spec for Aromatics (LVP) | | | | | | | | | |
| Alkylbenzenes | 11.62 | | 13.47 | 10.33 | 12.89 | | | | |
| Naphtheno Aromatics | 11.52 | | 12.8 | 12.1 | 12.93 | | | | |
| Two Ring Aromatics | 4.30 | | 6.91 | 5.23 | 5.93 | | | | |
| Three + Ring Aromatics | 0.60 | | 1.07 | 2.33 | 0.65 | | | | |
| Sulphur Aromatics | 1.59 | | 2.97 | 1.44 | 2.53 | | | | |
| Unidentifiable Aromatics | 0.76 | | 0.99 | 0.08 | 0.67 | | | | |

(1)Dewaxed using 100 LV % MIBK, 2.5/1 w/w s/o, fil;tered at −15° C.

TABLE 6A

NMP COUNTERCURRENT EXTRACTION DATA FOR ARAB LIGHT (150N) (2nd INSPECTION)

| | Run | | | |
|---|---|---|---|---|
| Additive | 1 — | 2 — | 3 Ethyl-benzene | 4 Ethyl-benzene |
| Extraction Conditions | | | | |
| Temperature, TOP/BOT °C. | 88/80 | 88/80 | 88/80 | 88/80 |
| Water in Solvent, LV % | 2.40 | 2.40 | 2.40 | 2.40 2.40 |
| Ethylbenzene Solvent, LV % | 0.00 | 0.00 | 5.00 | 5.00 |
| Treat, LV %(1) | 111 | 84 | 121 | 144 |
| Yield, LV %(1) | 52.88 | 58.34 | 49.89 | 47.57 |
| Extract Inspections | | | | |
| Solvent Content, Wt. % | 69.77 | 64.72 | 69.85 | 73.15 |
| RI @ 75° C. | 1.5310 | 1.5351 | 1.5269 | 1.5260 |
| Density @ 15° C., kg/dm$^3$ | 0.9760 | 0.9807 | 0.9726 | 0.9699 |
| Viscosity @ 100° C., cSt | 7.35 | 7.48 | 7.18 | 7.17 |
| Carry-under, LV % | 0.00 | 0.00 | 0.00 | 0.00 |
| Oil Content, LV %(2) | 31.56 | 36.61 | 31.56 | 28.22 |
| Waxy Raffinate Inspections | | | | |
| Solvent Content, Wt. % | 17.17 | 19.30 | 22.13 | 20.95 |
| RI @ 75° C. | 1.4556 | 1.4596 | 1.4545 | 1.4526 |
| Density @ 15° C., kg/dm$^3$ | 0.8671 | 0.8741 | 0.8650 | 0.8618 |
| Viscosity @ 40° C., cSt | 25.94 | 27.35 | 25.57 | 24.77 |
| Viscosity @ 100° C., cSt | 4.97 | 5.12 | 4.94 | 4.88 |
| Sulfur, Wt. % | | | | |
| Basic Nitrogen, wppm | | | | |
| Dewaxed Raffinate Inspections | | | | |
| Viscosity @ 40° C., cSt | 31.48(5) | 33.07(5) | 31.17(5) | 30.65(5) |
| Viscosity @ 100° C., cSt | 5.41(5) | 5.50(5) | 5.40(5) | 5.38(5) |
| VI | 106.0 - | 101.5 | 107.4 | 109.6 |
| Pour, °C. | −9 | −9 | −9 | −9 |
| VI @ −9° C.(4) | 106.2 | 101.7 | 107.5 | 109.9 |

NOTES:
(1)Calculated by material balance and corrected for carry-under
(2)Corrected for carry-under
(3)Dewaxed using 100LV % MIBK, 2.5/1 w/w s/o, filtered @ −15° C.
(4)VI predicted from extraction parameters
(5)Viscosity values correlated and not measured

TABLE 7

EFFECT OF TEMPERATURE ON YIELD CREDIT/DEBIT FOR NMP ETHYLBENZENE (5% DOSAGE) EXTRACTION OF VARIOUS OILS

| | Tower Bottom Temperature (TBT) °C. | Critical Solvent Temperature (CST °C.) | CST-TBT Delta °C. | 95 VI Yield Debit | Treat Relative % |
|---|---|---|---|---|---|
| BSM/AL 600N | 102 | 119 | 17 | 4% | −15 |
| AL 600N | 93 | 117 | 24 | 3.4% | −10 |
| AL 600N | 73 | 117 | 44 | NIL | −15 |
| Scona MCT 10 | 49 | 106 | 57 | NIL | −15 |
| AL 150N | 62 | 105 | 43 | NIL | −15 |
| AL 150N | 80 | 105 | 25 | 1.5% | — |

EXAMPLE IV

Countercurrent extractions with NMP solvent "spiked" with various types of additives were carried out on Arab Light 600N distillate sample (see Table 1). The additives studies were n-nonane, cyclohexanol, benzyl alcohol, toluene and n-butyl benzene*, aniline*, xylene* and amino ethyl morpholine* (wherein * indicates yield and treat calculations were conducted using "second inspection" data). In each case the NMP contained a 5.0 LV % level of additive so that the additives could be compared to ethylbenzene at a constant spiking level. All extractions were performed at the same temperature (top/bottom, °C. 81/73) and water in solvent level (2.4 LV %). The extraction results are shown in Tables 8 and 8A. For a given raffinate quality (93–95 VI, −9° C. pour point) the following results were observed.

EXTRACTION RESULTS

| ADDITIVE | EFFECT ON TREAT | EFFECT ON YIELD |
|---|---|---|
| n-nonane | no effect | increased by 1 LV % |
| cyclohexanol | lower by 20% (relative) | lower by 2 LV % |
| benzyl alcohol | increased by 12% (relative) | no effect |
| toluene | lower by 12% (relative) | lower by 1.5 LV % |
| n-butylbenzene | lower by about 15% (relative) | increased by 1.5% LV % |
| xylene | lower by about 15% (relative) | no effect |

Previous examples (above) show that with the addition of 5.0 LV % ethylbenzene to the NMP solvent, the treat requirement was reduced by 15 relative percent with no change in yield at bottoms operating temperatures below 80° C. These results indicate that the benefits of "spiking" the solvent with molecular additives are a function of both molecular type and weight, and the extraction parameters used, particularly temperatures and the additives tested. Ethyl benzene at a level of 5.0 LV % in NMP solvent has the largest process credits based on lab countercurrent extractions if tower bottoms temperature is more than 40° C. below the critical solution temperature of the feed-solvent mixture.

TABLE 8

NMP EXTRACTION OF ARAB LIGHT 600 DISTILLATE (FIRST INSPECTION) WITH AND WITHOUT SOLVENT ADDITIVES

| Solvent Additive | Base Case | | n-Nonane | | Cyclohexanol | | Benzyl Alcohol | | Toluene | |
|---|---|---|---|---|---|---|---|---|---|---|
| Extraction Conditions | | | | | | | | | | |
| Temperature, °C., T/B | 81/73 | 81/73 | 81/73 | 81/73 | 81/73 | 81/73 | 81/73 | 81/73 | 81/73 | 81/73 |
| Water in Solvent, LV % | 2.4 | 2.4 | 2.4 | 2.4 | 2.4 | 2.4 | 2.4 | 2.4 | 2.4 | 2.4 |
| Additive in Solvent, LV % | — | — | 5.0 | 5.0 | 5.0 | 5.0 | 5.0 | 5.0 | 5.0 | 5.0 |
| Treat, LV % | 141 | 229 | 140 | 237 | 143 | 215 | 144 | 232 | 137 | 208 |
| Yield, LV % | 64.6 | 59.1 | 66.5 | 59.1 | 60.3 | 55.5 | 66.1 | 60.2 | 62.7 | 56.9 |
| Extract Inspections | | | | | | | | | | |
| Oil Content, wt % | 21.1 | 15.4 | 21.4 | 15.5 | 22.7 | 17.4 | 20.1 | 14.9 | 22.9 | 17.6 |
| Refractive Index @ 75° C. | 1.5643 | 1.5569 | 1.5672 | 1.5586 | 1.5571 | 1.5518 | 1.5664 | 1.5589 | 1.5608 | 1.5535 |
| Gravity, ÅPI | 7.1 | 8.4 | 6.6 | 8.2 | 8.4 | 9.36 | 6.8 | 8.0 | 7.8 | 9.0 |
| Density @ 15° C., kg/dm$^3$ | 1.0203 | 1.0108 | 1.0240 | 1.0123 | 1.0108 | 1.0044 | 1.0225 | 1.0137 | 1.0152 | 1.0065 |
| Viscosity, 100° C., cSt | 40.25 | 36.02 | 41.99 | 37.49 | 36.39 | 33.44 | 38.71 | 37.30 | 38.18 | 34.91 |
| Entrainment, LV % | 0 | 0 | 0 | 0 | 0 | 0 | 0 | 0 | 0 | 0 |
| Raffinate Inspections | | | | | | | | | | |
| Solvent Content, wt % | 15.3 | 13.9 | 22.8 | 26.3 | 16.69 | 14.8 | 14.7 | 13.4 | 19.7 | 18.4 |
| Refractive Index @ 75° C. | 1.4728 | 1.4692 | 1.4737 | 1.4687 | 1.4712 | 1.4677 | 1.4736 | 1.4698 | 1.4723 | 1.4686 |
| Gravity, ÅPI | 26.4 | 27.3 | 26.1 | 27.6 | 26.9 | 27.8 | 26.1 | 27.3 | 26.6 | 27.6 |
| Density @ 15° C., kg/dm$^3$ | 0.8956 | 0.8906 | 0.8974 | 0.8889 | 0.8928 | 0.8878 | 0.8974 | 0.8906 | 0.8945 | 0.8889 |
| Viscosity, 100° C., cSt | 12.2 | 11.74 | 12.33 | 11.70 | 11.96 | 11.55 | 12.23 | 11.79 | 12.01 | 11.61 |
| Dewaxed Oil Inspections (1) | | | | | | | | | | |
| Wax Content, wt % | 13.3 | 14.2 | 12.7 | 14.5 | 13.5 | 14.7 | 12.69 | 14.0 | 13.0 | 14.5 |
| Refractive Index @ 75° C. | 1.4773 | 1.4733 | 1.4782 | 1.4728 | 1.4757 | 1.4720 | 1.4782 | 1.4741 | 1.4768 | 1.4728 |
| Gravity, ÅPI | 25.5 | 26.5 | 25.2 | 26.7 | 26.1 | 27.1 | 25.3 | 26.5 | 25.8 | 26.7 |
| Density @ 15° C., kg/dm$^3$ | 0.9008 | 0.8951 | 0.9025 | 0.8940 | 0.8974 | 0.8917 | 0.9019 | 0.8951 | 0.8991 | 0.8940 |
| Viscosity, 40° C., cSt | 144.81 | 131.11 | 146.59 | 129.67 | 137.34 | 126.77 | 144.98 | 133.42 | 140.15 | 128.03 |
| 100° C., cSt | 13.75 | 13.20 | 13.84 | 13.14 | 13.42 | 13.00 | 13.72 | 13.28 | 13.580 | 13.01 |
| Viscosity Index | 89.5 | 93.9 | 89.3 | 94.5 | 91.5 | 95.2 | 89 | 93 | 90.1 | 94.2 |
| Pour °C., ASTM | −9 | −9 | −9 | −9 | −9 | −9 | −9 | −9 | −9 | −9 |
| Sulphur, wt % | 1.46 | 1.18 | 1.48 | 1.13 | 1.30 | 1.08 | 1.48 | 1.21 | 1.40 | 1.15 |
| Basic Nitrogen, wppm | 92 | 81 | 103 | 71 | 89 | 67 | 102 | 83 | 91 | 82 |
| HPLC Separation | | | | | | | | | | |
| Saturates, wt % | 50.4 | 55.4 | 49.1 | 55.7 | 53.5 | 57.7 | 49.4 | 54.0 | 51.9 | 57.2 |
| Aromatics/Polars, wt % | 44.7 | 40.9 | 46.8 | 42.0 | 44.0 | 39.4 | 47.5 | 43.4 | 476.6 | 42.0 |
| Recovery, wt % | 95.1 | 96.3 | 95.9 | 97.7 | 97.5 | 97.1 | 96.8 | 97.5 | 98.6 | 99.2 |

DR #80-1707.

(1) Dexaxed using 100 LV % MIBK, 3/1 w/w s/o, filtered at −13° C.

TABLE 8A

NMP COUNTERCURRENT EXTRACTION DATA FOR ARAB LIGHT (SECOND INSPECTION)

| | Run | | | | | | | | |
|---|---|---|---|---|---|---|---|---|---|
| Additive | 1 None | 2 None | 3 Xylene | 4 Xylene | 5 Aniline | 6 Aniline | 7 N-Butyl Benzene | 8 N-Butyl Benzene | 9 Aminoethyl-morpholine(5) |
| Extraction Conditions | | | | | | | | | |
| Temperature, TOP/BOT, °C. | 81/73 | 81/73 | 81/73 | 81/73 | 81/73 | 81/73 | 81/73 | 81/73 | 77/77 |
| Water in Solvent | 2.40 | 2.40 | 2.40 | 2.40 | 2.40 | 2.40 | 2.40 | 2.40 | 2.40 |
| Additive in Solvent, LV % | 0.00 | 0.00 | 5.00 | 5.00 | 5.00 | 5.00 | 5.00 | 5.00 | 5.0 |
| Treat, LV %(1) | 144 | 237 | 128 | 212 | 130 | 211 | 132 | 214 | 200 |
| Yield, LV %(1) | 62.14 | 55.80 | 63.72 | 56.25 | 68.10 | 62.74 | 63.96 | 56.48 | 60.38 |
| Extract Inspections | | | | | | | | | |
| Solvent Content, Wt. % | 78.34 | 84.22 | 76.13 | 82.23 | 79.13 | 84.68 | 76.23 | 82.24 | 89.30 |
| RI @ 75° C. | 1.5618 | 1.5540 | 1.5628 | 1.5533 | 1.5710 | 1.5636 | 1.5625 | 1.5537 | 1.5471 |
| Density @ 15° C., kg/dm$^3$ | 1.0181 | 1.0081 | 1.0203 | 1.0087 | 1.0300 | 1.0210 | 1.0196 | 1.0086 | 1.0013 |
| Viscosity @ 100° C., cSt | 38.37 | 33.29 | 39.40 | 34.49 | 44.64 | 40.44 | 39.90 | 34.65 | |
| Carryunder, LV % | 0.00 | 0.00 | 0.00 | 0.50 | 0.00 | 0.00 | 1.00 | 0.80 | |
| Oil Content, LV %(2) | 22.00 | 16.18 | 24.20 | 17.92 | 21.01 | 15.55 | 23.60 | 17.74 | |
| Waxy Raffinate Inspections | | | | | | | | | |
| Solvent Content, Wt. % | 15.74 | 14.30 | 20.58 | 18.46 | 14.83 | 13.14 | 21.62 | 19.75 | 14.38 |
| RI @ 75° C. | 1.4723 | 1.4684 | 1.4736 | 1.4680 | 1.4759 | 1.4717 | 1.4731 | 1.4679 | 1.4691 |
| Density @ 15'0 C., kg/dm$^3$ | 0.8951 | 0.8889 | 0.8974 | 0.8895 | 0.9002 | 0.8951 | 0.8968 | 0.8889 | 0.8898 |
| Viscosity @ 40° C., cSt | | | | | | | | | |
| Viscosity @ 100° C., cSt | 11.90 | 11.58 | 12.26 | 11.61 | 12.55 | 12.06 | 12.24 | 11.65 | |
| Sulphur, Wt. % | | | | | | | | | |
| Basic Nitrogen, wppm | | | | | | | | | |
| Dewaxed Raffinate Inspections(3) | | | | | | | | | |
| Dry Wax Content, Wt. % | 12.0 | 13.3 | 11.7 | 13.5 | 11.1 | 12.4 | 11.8 | 13.4 | |

TABLE 8A-continued

NMP COUNTERCURRENT EXTRACTION DATA FOR ARAB LIGHT (SECOND INSPECTION)

| | Run | | | | | | | | |
|---|---|---|---|---|---|---|---|---|---|
| Additive | 1 None | 2 None | 3 Xylene | 4 Xylene | 5 Aniline | 6 Aniline | 7 N-Butyl Benzene | 8 N-Butyl Benzene | 9 Aminoethyl-morpholine(5) |
| RI @ 75° C. | 1.4762 | 1.4722 | 1.4778 | 1.4723 | 1.4799 | 1.4760 | 1.4773 | 1.4721 | |
| Density @ 15° C., kg/dm$^3$ | 0.8996 | 0.8934 | 0.9051 | 0.8969 | 0.9084 | 0.9022 | 0.9046 | 0.8965 | |
| Viscosity @ 40° C., cSt | 139.00 | 127.60 | 147.20 | 128.80 | 154.90 | 140.40 | 144.90 | 127.80 | |
| Viscosity @ 100° C., cSt | 13.45 | 13.01 | 13.74 | 13.07 | 14.09 | 13.55 | 13.72 | 13.05 | |
| VI | 90.0 | 95.0 | 87.5 | 94.3 | 85.9 | 90.6 | 89.1 | 94.8 | |
| Pour, °C. | −9 | −9 | −9 | −9 | −9 | −9 | −9 | −9 | |
| Saturates, Wt. % | 52.5 | 58.2 | 49.9 | 54.8 | 47.1 | 52.2 | 49.7 | 55.9 | |
| Aromatics & Polars, Wt. % | 44.7 | 38.2 | 46.6 | 41.2 | 48.6 | 44.2 | 45.1 | 40.4 | |
| Sulphur, Wt. % | 1.34 | 1.10 | 1.43 | 1.08 | 1.54 | 1.30 | 1.40 | 1.05 | |
| Basic Nitrogen, wppm | | | | | | | | | |
| VI @ −9° C.(4) | 90.4 | 94.6 | 89.2 | 94.1 | 87.5 | 91.3 | 89.2 | 94.0 | |

NOTES:
(1)Calculated by material balance and corrected for carryunder.
(2)Corrected for carryunder.
(3)Dewaxing conditions: 100 LV % MIBK, 3/1 s/o, filtered @ −13° C.
(4)VI predicted from extraction parameters.
(5)Aminoethylmorpholine as co-solvent in batch extraction.

One of the more surprising observations was the difference in the effects of cyclohexanol and benzyl alcohol. Benzyl alcohol (a polar substituted aromatic) increased the treat by 12% while cyclohexanol (a polar naphthene) decreased the treat by 20%.

With the n-nonane case it was noted that the refractive index of the oil from the water washed raffinate solution was lower, by about 0.0060, than that of the oil from the stripped solution. This difference is attributed to n-nonane that is present in the water washed oil but which is evaporated from the stripped sample.

Toluene and cyclohexanol exhibited treat advantages which were somewhat offset by a yield debit. Despite this, toluene and cyclohexanol are within the scope of this invention as there are instances when minor loss in yield is an acceptable price to pay to achieve a treat rate advantage, as in those instances when an extraction process had equipment and/or solvent handling limitations. Aniline has a polar substituted group versus the alkyl group substitution of ethylbenzene. The desired higher quality level of 95 VI was not attained with aniline, but even at 90 VI an unfavorable treat level was necessary. The yield advantage (1.4 LV %) did not offset the treat debit (+29LV %, relative).

EXAMPLE V

Five additional countercurrent extractions were performed to demonstrate the credits of a commercial grade ethylbenzene from Polysar and to identify the advantages of ethylbenzene addition to the solvent as opposed to addition to the feed oil.

A sample of commercial grade ethylbenzene was obtained from Polysar and analysed by gas chromatography. It indicated the ethylbenzene content was 99.5 wt %. This sample was used to "spike" solvent or feed of the extractions in this study.

The distillate used in this study was Arab Light 600N distillate (first inspection information used for calculations).

Due to a change in NMP solvent source and some changes in the solvent properties a new set of base case extractions with no additive was run at the standard conditions of extraction temperature, top/bottom, 81°/73° C., and water in solvent of 2.4 LV %. Extractions were performed to two raffinate target levels of about 90 and 95 VI at −9° C. pour. The two extractions were repeated with the addition of 5 LV % ethylbenzene to the extraction solvent. The results of the four extractions are given in Table 9.

On FIG. 1 the RI/VI relationship is shown for the extraction data with and without ethylbenzene. The ethylbenzene has no apparent effect on this relationship so waxy raffinate RI was used as a measure of raffinate quality and a correlated VI value was drawn from FIG. 1.

Figure 2:
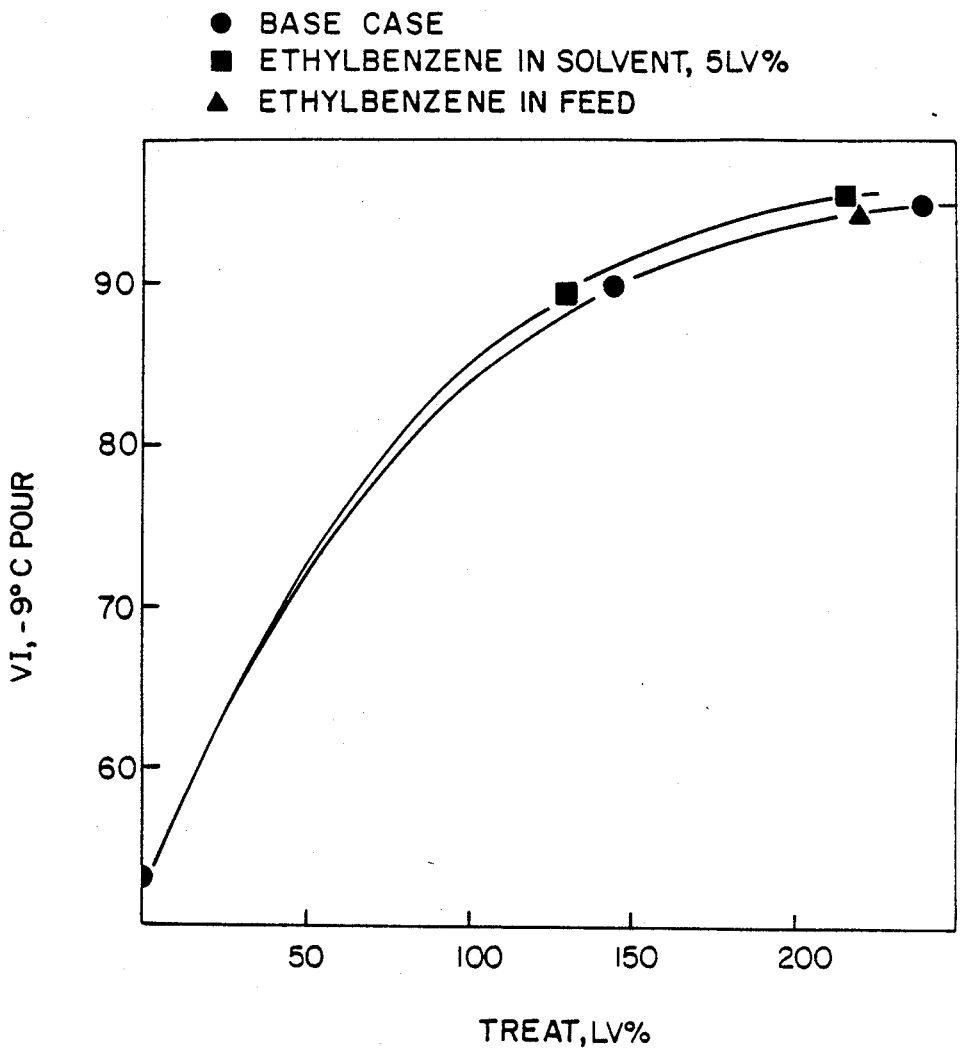
FIG. 2 represents the relationship between treat level and viscosity index for products produced using extraction solvents, both with and without ethylbenzene additive, and wherein the ethylbenzene is used in two different manners—in the solvent or added separately to the feed.

FIG. 2 compares the treat/VI relationships with and without ethylbenzene. Treat is defined as the ratio of solvent (NMP, Water and Ethylbenzene) to feed on a percentage basis. For a 90 VI raffinate the addition of 5 LV % ethylbenzene decreases the solvent treat from 145 LV % to 130 LV %, a 10 relative percent treat reduction. For a 95 VI product the treat drops from 239 LV % to 200 LV %, a 16 relative percent treat reduction.

Figure 3:
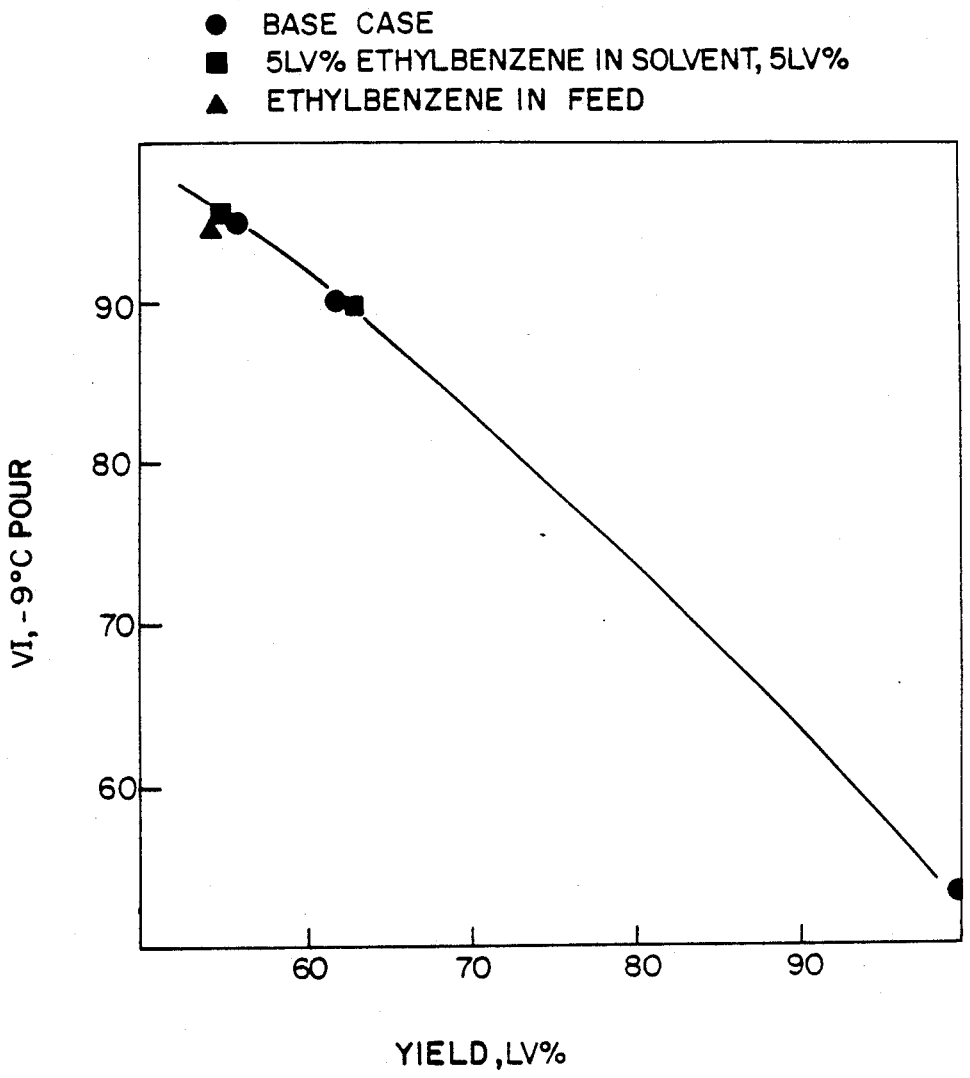
FIG. 3 presents the relationship between yield and viscosity index for products produced using extraction solvents, both with and without ethylbenzene, and wherein the ethylbenzene is used in two different manners—in the solvent or added separately to the feed.

As shown on FIG. 3 this treat credit is attained with no yield debit.

One extraction was performed adding ethylbenzene to the feed as opposed to having the ethylbenzene already present in the the extraction solvent. This run (Table 9, Run 5) was performed with the same material flows as the additive run (Table 9, Run 4); however, the ethylbenzene is added to the extraction zone in a different location. Using the definition that treat is a ratio of NMP plus water plus ethylbenzene, to the feed oil, the extraction point is shown on the treat/VI relationship on FIG. 3. The treat credit indicated is between 0 and 8 relative percent, much lower than that found with adding the same ethylbenzene to the solvent. In addition FIG. 3 indicates that there is a yield debit in the order of 1.5 LV % associated with adding the ethylbenzene to the feed. The combination of the yield debit and the decreased treat credits indicate that the location of the ethylbenzene addition is very important and that solvent addition is superior to feed addition.

TABLE 9

NMP EXTRACTION OF ARAB LIGHT 600N DISTILLATE

| | Run | | | | |
|---|---|---|---|---|---|
| | 1 | 2 | 3 | 4 | 5 |
| Additive | 0 | 0 | Ethylbenzene to Solvent | | Ethylbenzene to Feed |
| Extraction Conditions | | | | | |
| Temp, °C., Top/Bttm. | 81/73 | 81/73 | 81/73 | 81/73 | 81/73 |
| Water in Solvent, LV % | 2.4 | 2.4 | 2.4 | 2.4 | 2.5 |
| Additive in Solvent, LV % | — | — | 5.0 | 5.0 | 0 |
| Treat, LV %(1) | 145 | 239 | 130 | 217 | 219 |
| Yield, LV % | 62.14 | 55.80 | 63.45 | 55.05 | 54.26 |
| Extract Inspections | | | | | |
| Oil Content, Wt. % | 21.66 | 15.78 | 24.02 | 17.87 | 17.55 |
| RI @ 75° C. | 1.5618 | 1.5540 | 1.5624 | 1.5523 | 1.5508 |
| Gravity, ÅPI | 7.4 | 8.8 | 7.3 | 9.1 | 9.4 |
| Density @ 15° C., kg/dm$^3$ | 1.0181 | 1.0081 | 1.0188 | 1.0058 | 1.0037 |
| Viscosity @ 100° C., cSt | 38.37 | 33.29 | 38.47 | 32.35 | 0.5 |
| Entrainment, LV % | 0 | 0 | 0.5 | 0.5 | — |
| Raffinate Inspections | | | | | |
| Solvent Content, Wt. % | 15.74 | 14.30 | 20.49 | 18.20 | 14.19 |
| RI @ 75° C. | 1.4723 | 1.4684 | 1.4730 | 1.4679 | 1.4685 |
| Gravity, ÅPI | 26.5 | 27.6 | 26.2 | 27.8 | 27.5 |
| Density @ 15° C., kg/dm$^3$ | 0.8951 | 0.8889 | 0.8968 | 0.8878 | 0.8895 |
| Viscosity @ 100° C., cSt | 11.90 | 11.58 | 12.09 | 11.52 | |
| Dewaxed Raffinate | | | | | |
| Dry Wax Yield, Wt. % | 12.03 | 13.28 | 11.57 | 13.17 | — |
| RI @ 75° C. | 1.4762 | 1.4722 | 1.4775 | 1.4720 | — |
| Gravity, ÅPI | 25.7 | 26.8 | 25.4 | 27.0 | — |
| Density @ 15° C. | 0.8996 | 0.8934 | 0.9014 | 0.8923 | — |
| Viscosity @ 40° C., cSt | 139.0 | 127.6 | 144.2 | 126.7 | — |
| Viscosity @ 100° C., cSt | 13.45 | 13.01 | 13.64 | 13.02 | — |
| VI | 90 | 95 | 89 | 96 | — |
| Pour, °C. | −9 | −9 | −9 | −9 | — |
| Sulphur, Wt. % | 1.34 | 1.10 | 1.44 | 1.06 | — |
| HPLC, Sats. Wt. % | 52.5 | 58.2 | 50.2 | 56.8 | — |
| Aromatics & Polars | 44.7 | 38.2 | 45.1 | 39.7 | |
| Basic $N_2$, ppm | — | 51 | — | 56 | — |

(1)Treat is defined as (Vol NMP + Vol $H_2O$ + Vol Ethylbenzene) × 100/(Vol Oil Feed).

EXAMPLE VI

Four additional additives were evaluated in NMP extraction. Cyclohexanone, cyclohexylamine, ethanolamine and morpholine were employed as additives at 5 LV % treat rates with 2.4 LV % water in the NMP extraction of Arab light 600N distillate (second inspection data used as basis for calculations). Tower top/bottom temperature profile was 81°/73° C. Raffinate and VI target quality was 90–95 VI and −9° C. pour point. Table 10 presents the results.

TABLE 10

EFFECT OF SOLVENT ADDITIVES ON NMP EXTRACTION OF ARAB LIGHT 600N DISTILLATE

| Additive | 0 | 0 | Cyclohexanone | | Morpholine | | Cyclohexylamine | | Ethanolamine | |
|---|---|---|---|---|---|---|---|---|---|---|
| Extraction Conditions | | | | | | | | | | |
| Temp. °C. Top/Bttm | 81/73 | 81/73 | 81/73 | 81/73 | 81/73 | 81/73 | 81/73 | 81/73 | 81/73 | 81/73 |
| Water in Solvent, LV % | 2.4 | 2.4 | 2.4 | 2.4 | 2.4 | 2.4 | 2.4 | 2.4 | 2.4 | 2.4 |
| Solvent Additive, LV % | — | — | 5.0 | 5.0 | 5.0 | 5.0 | 5.0 | 5.0 | 5.0 | 5.0 |
| Treat, LV % | 145 | 239 | 134 | 213 | 138 | 221 | 133 | 215 | 135 | 222 |
| Yield, LV % | 62.14 | 55.80 | 61.88 | 55.32 | 63.63 | 57.27 | 60.55 | 54.49 | 71.82 | 66.74 |
| Extract Inspections | | | | | | | | | | |
| Oil Content, Wt. % | 21.66 | 15.78 | 24.06 | 18.25 | 22.74 | 17.13 | 24.35 | 17.84 | 19.24 | 14.15 |
| RI @ 75° C. | 1.5618 | 1.5540 | 1.5591 | 1.5509 | 1.5619 | 1.5545 | 1.5586 | 1.5519 | 1.5762 | 1.5681 |
| Gravity, ÅPI | 7.4 | 8.8 | 7.8 | 9.1 | 7.2 | 8.7 | 8.1 | 9.1 | 4.6 | 6.2 |
| Den. @ 15° C., kg/dm$^3$ | 1.0181 | 1.0081 | 1.0152 | 1.0058 | 1.0196 | 1.0087 | 1.0130 | 1.0058 | 1.0390 | 1.0270 |
| Visc. @ 100° C., cSt | 38.37 | 33.29 | 35.32 | 29.57 | 38.04 | 34.38 | 36.67 | 33.29 | 51.06 | 43.74 |
| Entrainment, LV % | 0 | 0 | 1.0 | 1.0 | 1.0 | 1.0 | 0 | 0 | 1.0 | 1.0 |
| Raffinate Inspections(1) | | | | | | | | | | |
| Solvent Content, Wt. % | 15.74 | 14.30 | 18.04 | 15.81 | 16.86 | 15.45 | 19.67 | 17.66 | 14.85 | 13.53 |
| RI @ 75° C. | 1.4723 | 1.4684 | 1.4723 | 1.4679 | 1.4727 | 1.4683 | 1.4721 | 1.4678 | 1.4770 | 1.4734 |
| Gravity, ÅPI | 26.5 | 27.6 | 26.5 | 27.7 | 26.3 | 27.5 | 26.5 | 27.7 | 25.2 | 26.2 |
| Den., @ 15° C., kg/dm$^3$ | 0.8951 | 0.8889 | 0.8951 | 0.8883 | 0.8962 | 0.8895 | 0.8951 | 0.8883 | 0.9025 | 0.8968 |
| Visc., 100° C., cSt | 11.90 | 11.58 | 11.97 | 11.37 | 11.83 | 11.44 | 12.09 | 11.54 | 12.63 | 12.19 |
| Dewaxed Raffinate | | | | | | | | | | |
| Dry Wax Yield, Wt. % | 12.03 | 13.28 | 12.25 | 13.67 | 11.88 | 13.62 | 12.29 | 13.84 | 11.52 | 11.89 |
| RI @ 75° C. M D75 | 1.4762 | 1.4722 | 1.4764 | 1.4719 | 1.4771 | 1.4726 | 1.4761 | 1.4716 | 1.4809 | 1.4774 |
| Gravity, ÅPI | 25.7 | 26.8 | 25.8 | 27.0 | 25.7 | 26.8 | 25.7 | 27.1 | 24.1 | 25.3 |
| Den., 15° C., kg/dm$^3$ | 0.8996 | 0.8934 | 0.8991 | 0.8923 | 0.8996 | 0.8934 | 0.8996 | 0.8917 | 0.9089 | 0.9019 |
| Visc., 40° C., cSt | 139.0 | 127.6 | 140.2 | 127.3 | 142.1 | 128.1 | 139.9 | 126.5 | 159.9 | 144.9 |
| Visc., 100° C., cSt | 13.45 | 13.01 | 13.50 | 12.98 | 13.54 | 13.02 | 13.48 | 12.93 | 14.22 | 13.64 |
| VI | 90 | 95 | 90 | 94.5 | 89 | 94 | 90 | 94.5 | 84 | 88 |

TABLE 10-continued

EFFECT OF SOLVENT ADDITIVES ON NMP EXTRACTION OF ARAB LIGHT 600N DISTILLATE

| Additive | 0 | 0 | Cyclohexanone | | Morpholine | | Cyclohexylamine | | Ethanolamine | |
|---|---|---|---|---|---|---|---|---|---|---|
| Pour, °C. | −9 | −9 | −9 | −9 | −9 | −9 | −9 | −9 | −12 | −12 |
| Sulphur, Wt. % | 1.34 | 1.10 | 1.35 | 1.06 | 1.38 | 1.09 | 1.42 | 1.11 | 1.72 | 1.47 |
| HPLC, Sats, Wt. % | 52.5 | 58.2 | 50.3 | 56.0 | 50.0 | 55.0 | 51.7 | 56.6 | 46.4 | 52.0 |
| Ar. + Po. Wt. % | 44.7 | 38.2 | 46.7 | 41.1 | 46.7 | 42.4 | 46.3 | 40.8 | 50.6 | 47.6 |
| Rec. % | 97.2 | 96.4 | 9710 | 97.1 | 96.7 | 97.4 | 98.0 | 97.3 | 97.0 | 99.6 |
| Basic $N_2$, wppm | 74 | 51 | — | 53 | — | 62 | — | 63 | — | 93 |

(1)Dewaxing conditions: 100 LV % MIBK, 3/1 w/w s/o, filtered at −13° C.

As is seen from Table 10, cyclohexanone (a naphthene bearing a polar group) reduces the treat from 239 LV % (no additives) to 213 LV % at 5 LV % treat level, a reduction of about 15% with essentially no change in yield.

The cyclohexylamine reduced treat by about 15%, but was accompanied by a loss in yield. Further, the resulting raffinate had a higher basic nitrogen content. This additive is within the scope of the present invention despite the loss in yield and can be employed in those instances when reduction in treat rate is needed due to equipment and solvent handling limitations and when minor losses in yield are the accepted price to pay to achieve this treat rate advantage.

Use of ethanol resulted in an overall treat debit and yield debit and VI target could not be met, even at higher treat rates.

Morpholine reduced treat by about 8% and was accompanied by a yield credit of about 2%.

EXAMPLE VII

Cyclohexanone was further investigated in combination with NMP. The cyclohexanone was evaluated at concentrations of 2.5 and 10 LV % for the extraction of an Arab Light 600N distillate. The extractions were carried out using 2.4 LV % water in the solvent. Tower top/bottom temperature profile was 81°/73° C. Two runs were performed using 5 LV % cyclohexanone in NMP, 2.4 LV % water in solvent as extraction solvent but at a tower top/bottom temperature profile of 101°/93° C. These data are reported in Table 12. It is seen that at 10 LV % ketone in solvent a yield debit arises. This is to be compared with runs conducted using zero additive and 5 LV % additive. All calculations for all runs in this Example are based on the Arab Light 600N inspection reported in Table 11. This inspection was conducted on a portion of Arab Light 600N taken from the same drum as were the other Arab Light 600N's reported and utilized in the Examples of this case. One sees that the maximum benefit is achieved at about 5 LV % additive. The data also indicates that it is important to run at least 30° C. and preferably 40° C. below the critical solution temperature. The critical solution temperature for oil/solvent having 5 LV % cyclohexanone is 117° C. (for this feed). When solvent having 5 LV % cyclohexanone was used at a top/bottom temperature profile of 101°/93° C. no treat credits are obtained, while at a temperature profile of 81°/73° C. about 15% credits are obtained.

TABLE 11

DISTILLATE INSPECTION FOR ARABIAN LIGHT 600N

| | |
|---|---|
| Waxy Oil Inspections | |
| RI @ 75° C. | 1.5058 |
| Density @ 15° C., Kg/DM$^3$ | 0.9406 |
| Viscosity @ 100° C., CST | |
| Dewaxed Oil Inspections | |
| Dry Wax Content, Weight | 8.3 |
| RI @ 75° C. | 1.5115 |
| Density @ 15° C., Kg/DM$^3$ | 0.9491 |
| Viscosity @ 40°, CST | 325.89 |
| Viscosity @ 100° C., CST | 18.89 |
| VI | 51.1 |
| Pour, °C. | −15 |
| Saturates, Weight | 33.5 |
| Aromatics & Polars, Weight | 59.8 |
| Sulphur, Weight | 3.02 |
| Basic Nitrogen, wppm | 320 |
| Aniline Point, °C. | |

TABLE 12

NMP COUNTERCURRENT EXTRACTION DATA FOR ARABIAN LIGHT 600N USING CYCLOHEXANONE AS ADDITIVE

| Run | 1 | 2 | 3 | 4 | 5 | 6 | 7 | 8 | 9 | 10 |
|---|---|---|---|---|---|---|---|---|---|---|
| Extraction Conditions | | | | | | | | | | |
| Temperature, Top/Bottom °C. | 81/73 | 81/73 | 101/93 | 101/93 | 81/73 | 81/73 | 81/73 | 81/73 | 101/93 | 101/93 |
| Water in Solvent, LV % | 2.40 | 2.40 | 2.40 | 2.40 | 2.40 | 2.40 | 2.40 | 2.40 | 2.40 | 2.40 |
| Oil in Solvent, LV % | 0.00 | 0.00 | 0.00 | 0.00 | 0.00 | 0.00 | 0.00 | 0.00 | 0.00 | 0.00 |
| Cyclohexanone, LV % | 0.00 | 0.00 | 0.00 | 0.00 | 5.0 | 5.0 | 2.5 | 10.0 | 5.0 | 5.0 |
| Treat, LV % (1) | 142 | 234 | 111 | 174 | 131 | 208 | 139 | 184 | 161 | 149 |
| Yield, LV % (1) | 62.79 | 56.47 | 51.91 | 46.98 | 62.49 | 55.92 | 62.49 | 53.41 | 43.17 | 44.81 |
| Extract Inspections | | | | | | | | | | |
| Solvent Content, Wt. % | 78.34 | 84.22 | 68.00 | 76.60 | 75.94 | 81.75 | 77.68 | 79.41 | 73.64 | 72.51 |
| RI @ 75° C. | 1.5618 | 1.5540 | 1.5433 | 1.5408 | 1.5591 | 1.5509 | 1.5611 | 1.5490 | 1.5367 | 1.5380 |
| Density @ 15° C. Kg/DM$^3$ | 1.0181 | 1.0081 | 0.9917 | 0.9889 | 1.0152 | 1.0058 | 1.0162 | 1.0013 | | |
| Viscosity @ 100° C., CST | 38.37 | 33.29 | 27.69 | 27.42 | | | | | | |
| Carry Under, LV % | 0.00 | 0.00 | 1.00 | 0.00 | 1.00 | 1.00 | 0.00 | 0.00 | 27.43 | 28.55 |
| Oil Content, LV % (2) | 22.0 | 16.18 | 32.59 | 24.29 | 23.97 | 18.17 | 22.70 | 21.20 | | |
| Waxy Raffinate Inspections | | | | | | | | | | |
| Solvent Content, Wt. % | 15.74 | 14.30 | 20.30 | 18.50 | 18.04 | 15.81 | 17.22 | 19.08 | 21.77 | 22.14 |
| RI @ 75° C. | 1.4723 | 1.4684 | 1.4706 | 1.4663 | 1.4723 | 1.4679 | 1.4724 | 1.4680 | 1.4652 | 1.4661 |
| Density @ 15° C., Kg/DM$^3$ | 0.8951 | 0.8889 | 0.8917 | 0.8861 | 0.8951 | 0.8883 | 0.8955 | 0.8878 | 0.8835 | 0.8850 |
| Viscosity @ 40° C., CST | | | | | | | | | | |
| @ 100° C., CST | 11.90 | 11.58 | 11.86 | 11.42 | 11.97 | 11.37 | | | | |
| Sulphur, Wt. % | | | | | | | | | | |

TABLE 12-continued

NMP COUNTERCURRENT EXTRACTION DATA FOR ARABIAN LIGHT 600N USING CYCLOHEXANONE AS ADDITIVE

| Run | 1 | 2 | 3 | 4 | 5 | 6 | 7 | 8 | 9 | 10 |
|---|---|---|---|---|---|---|---|---|---|---|
| Basic Nitrogen, wppm | | | | | | | | | | |
| Dewaxed Raffinate Inspections (3) | | | | | | | | | | |
| Dry Wax Content, Wt. % | 12.0 | 12.0 | 13.6 | 15.3 | 12.2 | 13.7 | | | | |
| RI @ 75° C. | 1.4762 | 1.4722 | 1.4748 | 1.4703 | 1.4764 | 1.4719 | | | | |
| Density @ 15° C., Kg/DM$^3$ | 0.8996 | 0.8934 | 0.8968 | 0.8900 | 0.8991 | 0.8923 | | | | |
| Viscosity @ 40° C., CST | 139.00 | 127.60 | 135.40 | 121.40 | 140.20 | 127.30 | | | | |
| Viscosity @ 100° C., CST | 13.45 | 13.01 | 13.36 | 12.80 | 13.50 | 13.98 | | | | |
| VI | 90.0 | 94.4 | 92.0 | 96.4 | 90.0 | 94.8 | 90.0* | 94.8* | 97.6* | 96.8* |
| Pour, °C. | −9 | −9 | −9 | −9 | −9 | −9 | −9* | −9* | −9* | −9* |
| Saturates, Wt. % | 52.5 | 58.2 | 53.7 | 59.5 | 50.3 | 56.0 | | | | |
| Aromatics + Polars, Wt. % | 44.7 | 38.2 | 42.7 | 39.9 | 46.7 | 41.1 | | | | |
| Sulphur, Wt. % | 1.34 | 1.10 | 1.29 | 0.98 | 1.35 | 1.06 | | | | |
| Basic Nitrogen, wppm | | | | | | | | | | |

(1) Calculated by material balance and corrected for carry under.
(2) Corrected for carry under.
(3) Dewaxing conditions: 100% MIBK, W/W S/O 3/1, filtered @ −13° C.
*From RI/VI correlation.

What is claimed is:

1. A method for extracting aromatic molecules from hydrocarbon oil using a combination extraction solvent containing (a) N-methyl pyrrolidone, (b) from about 1 to up to but not including 10 LV % of the combination of an additive selected from aliphatic-aromatics, polar naphthenes, morpholine and mixtures thereof, and (c) from 0 to 10 LV % water; wherein the amount of component (a) is suitably adjusted to reflect the presence of any water used, said extraction being conducted at a temperature above the haze point of the oil, but at least 30° C. below the critical solution temperature of the mixture of hydrocarbon oil and combination extraction solvent.

2. The method of claim 1 wherein component (b) is present at about 2.5 to 5 LV % of the combination.

3. The method of claim 1 wherein the temperature of extraction is 40° C. or more below the critical solution temperature of the hydrocarbon oil and the combination extraction solvent.

4. The method of claim 1 wherein component (b) is ethylbenzene, butylbenzene or morpholine.

5. The method of claim 2 wherein the temperature of extraction is 40° C. or more below the critical solution temperature of the hydrocarbon oil and the combination extraction solvent.

6. The method of claim 2 wherein component (b) is ethylbenzene, butylbenzene or morpholine.

7. The method of claim 1 wherein the component (b) is a polar naphthene.

8. The method of claim 3 wherein component (b) is ethylbenzene, butylbenzene or morpholine.

9. The method of claim 5 wherein component (b) is ethylbenzene, butylbenzene or morpholine.

* * * * *